United States Patent [19]

Lindsay

[11] 3,958,745

[45] May 25, 1976

[54] PARTITION TRAY FOR INSERTION INTO A BOX

[75] Inventor: La Vern G. Lindsay, Petersburg, Mich.

[73] Assignee: Union Camp Corporation, Wayne, N.J.

[22] Filed: July 28, 1975

[21] Appl. No.: 599,924

[52] U.S. Cl. ..... 229/15; 229/42; 229/27

[51] Int. Cl.[2] ..... B65D 3/24; B65D 5/48

[58] Field of Search ..... 229/15, 27, 28 R, 42; 217/18, 19

[56] References Cited

UNITED STATES PATENTS

| | | | |
|---|---|---|---|
| 3,236,433 | 2/1966 | Barrett et al. | 229/15 |
| 3,317,111 | 5/1967 | Black | 229/15 |
| 3,871,569 | 3/1975 | Waarton | 229/42 X |

*Primary Examiner*—Davis T. Moorhead

[57] ABSTRACT

A partition tray formed from a single piece blank cut, scored and slotted to form a bottom with panels framing the bottom which panels can be cross folded and locked over the bottom into a cellular partition tray suitable for insertion into a box.

6 Claims, 7 Drawing Figures

Fig. 5.
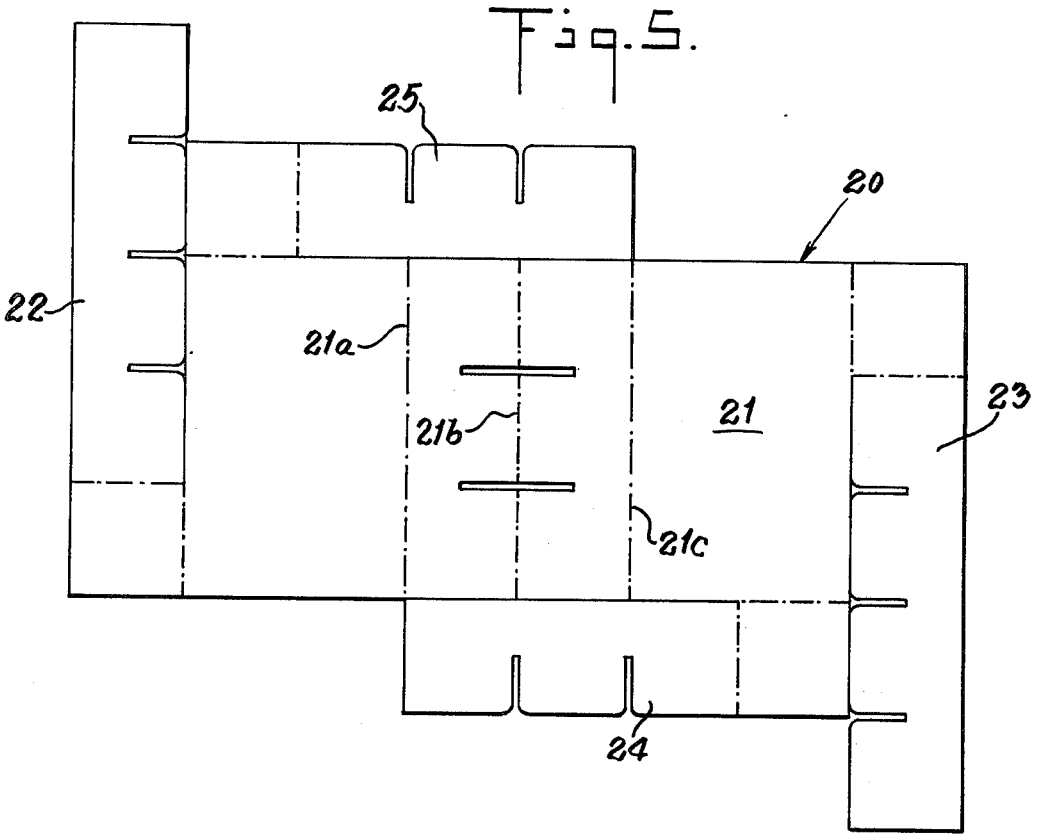
Fig. 6.
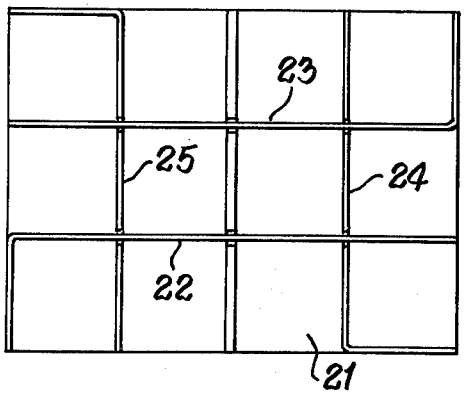
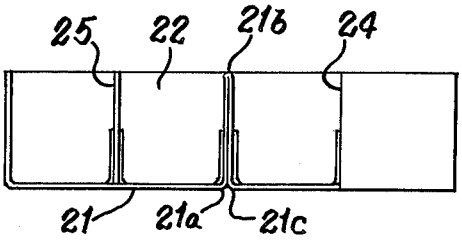
Fig. 7.

PARTITION TRAY FOR INSERTION INTO A BOX

BACKGROUND OF THE INVENTION

This invention relates to an improvement in partition trays and more particularly to a tray made from a single piece blank which can be inserted into a box to provide cells suitable for packing and shipping products.

Most partition trays are formed by fitting together separate pieces to provide the desired cells. The present invention seeks to simplify the formation of such tray by fabricating it from a single piece blank which can be set up to provide the cells.

SUMMARY OF THE INVENTION

It is an object of the invention to provide a partition tray suitable for insertion into a box for packing and shipping products in separate cells.

It is a further object to provide a partition tray which can be formed from a single piece blank.

It is a further object to provide a blank which is simple and economical to manufacture and can easily be set up into a partition tray which is efficient and well suited for its intended purpose.

BRIEF DESCRIPTION OF THE DRAWINGS

Other objects and advantages will become apparent from the following description which is to be taken in conjunction with the accompanying drawings, in which:

FIG. 5 is a plan view of a blank for a modified form of partition tray;

FIG. 6 is a top view of the modified form of partition set up with the blank of FIG. 5; and FIG. 7 is a side view of the tray of FIG. 6.

DESCRIPTION OF THE PREFERRED EMBODIMENT

Figure 1:
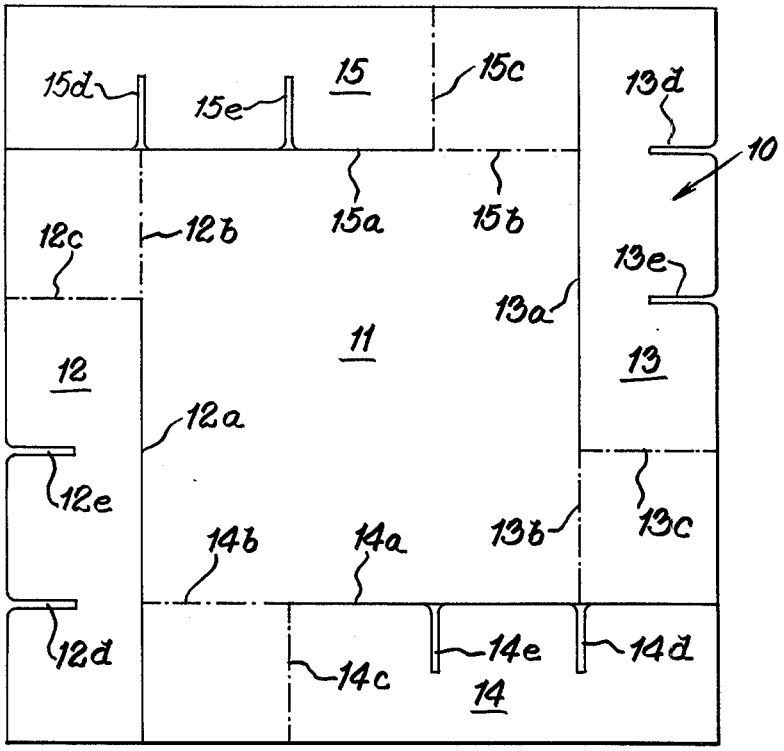
FIG. 1 is a plan view of a blank for the partition tray of the present invention.

Referring to the drawings, there is shown in FIG. 1 a flat substantially square blank 10 of sheet material, such as corrugated board, fiberboard or the like, of a weight suitable for the type of tray to be constructed. The blank 10 consists of a bottom panel 11 framed by a series of panels 12, 13, 14 and 15 which, when the blank is set up, will form the walls of the cells of the tray. The panel 12 is formed by cutting the blank along the line 12*a* and leaving the panel connection to the bottom panel 11 only along the hinge score line 12*b*. Such panel 12 has a hinge score line 12*c* normal to the hinge score line 12*b* and is provided with slots 12*d* and 12*e* cut in from the outer edge of the said panel. Such slots 12*d* and 12*e* extend into the panel 12 approximately half of the width of such panel. The score line 12*c* and the slots 12*d* and 12*e* define cell segments which when the blank is set up into a tray will each form the side of a cell. Similarly, panels 13, 14 and 15 are cut, scored and slotted in the same manner and designated by the corresponding letters *a*, *b*, *c*, *d* and *e*.

Figure 2:
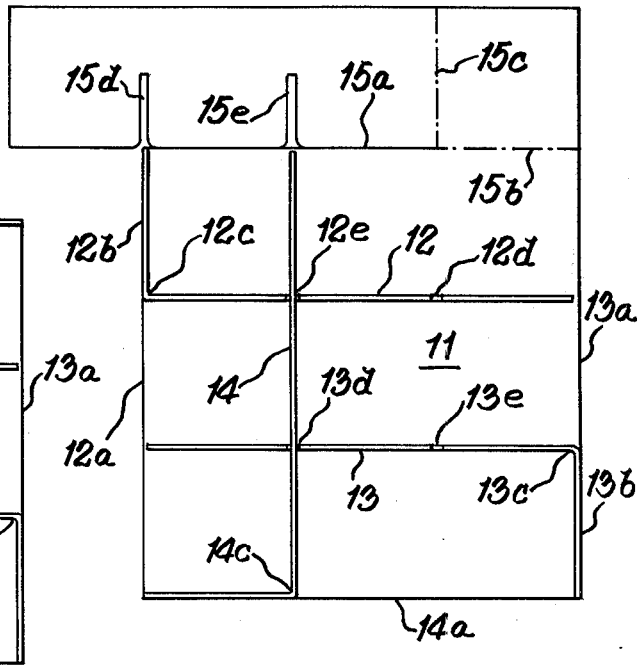
FIG. 2 is a top view of the blank of FIG. 1 with some of the panels folded into position.

Referring to FIG. 2, the blank is set up into a tray by folding the panel 12 along the hinge score line 12*a* so that the panel is at a right angle to the bottom panel 11. The panel is then folded along the hinge score line 12*c* so that the portion of the panel with the cell segments, defined by the score line 12*c* and the slots 12*d* and 12*e*, will be a right angle to the remaining portion of such panel. The panel 12 is of such length that the larger portion of the panel will extend across the bottom panel to the opposite edge 13*a* of such bottom panel.

Panel 13 is folded in the same manner as panel 12 was folded except that it extends in the opposite direction to the edge 12*a* of the bottom panel. The folded panels 12 and 13 now define two rows across the bottom panel.

Figure 3:
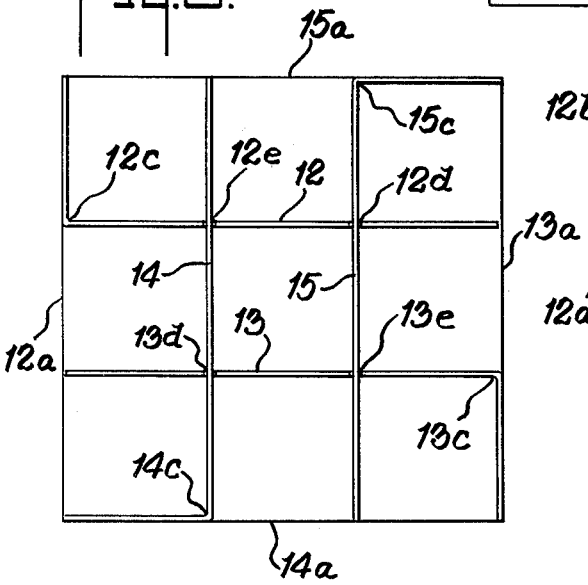
FIG. 3 is a top view of the blank of FIG. 1 with all the panels folded into position to complete the partition tray ready for insertion into a box.
Figure 4:
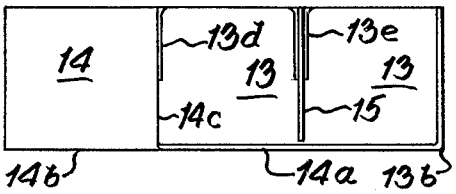
FIG. 4 is a side view of the completed tray of FIG. 3.

Panel 14 is now folded upwardly and crosswise in the same manner as panels 12 and 13 were folded, except that it extends to the edge 15*a* of the bottom panel. The slots 14*d* and 14*e* extend downwardly and are slipped into the upwardly projecting slots 13*d* and 12*e*. Similarly, panel 15 is folded upwardly and crosswise in the same manner as panel 14 except that it extends to the edge 14*a* of the bottom panel. The slots 15*d* and 15*e* are fitted into the slots 12*d* and 13*e*, respectively. This completes the setting up of the blank into a partition tray (FIGS. 3 and 4).

Although the slots *d* and *e* of panels 12 and 13 project upwardly and the slots *d* and *e* of panels 14 and 15 project downwardly, it will be understood that the slots of the panels can project in either direction so long as the interfitting slot projects in the opposite direction. Furthermore, although the slots are shown as cut approximately halfway into the width of the panel, it will be understood that such slots can vary in depth so long as the interfitting slot is matching.

The cells of the completed partition tray are shown as generally being square in shape. However, the lengths of the panels and hinge lines and the positions of the slots can be varied to form cells which are rectangular or of other shape, depending on the shape of cells desired for the particular product to be packaged. Furthermore, all of the cells need not be of the same shape or size.

The bottom panel is shown in FIGS. 1 – 4 as generally being square in shape. However, the bottom panel can be rectangular in which case the lengths of the panels and hinge lines and the positions of the slots can be varied to form cells which are rectangular or of other shape. Here again, all of the cells need not be of the same shape or size.

FIGS. 5 – 7 show a modified form of tray in which the bottom panel has a center portion folded upwardly to form a center double wall panel normal to the bottom panel. Such double wall panel is provided with slots to receive the other wall panels folded across the bottom. Referring to such figures there is shown a flat blank 20 which consists of a bottom panel 21 framed by a series of panels 22, 23, 24 and 25 which, when the blank is set up, will form the walls of the cells of the tray. Such panels are cut, scored, slotted and hinged in the same manner as the panels 12, 13, 14 and 15 shown in FIGS. 1 – 4.

The bottom panel 21 has three-spaced score lines 21*a*, 21*b* and 21*c* parallel to each other and to two opposite sides of the bottom panel. Such score lines define a center portion of the bottom panel. Running at right angles to such score lines and cutting through the center score line 21*b* are two-spaced parallel slots. Such slots are positioned to line up with the slots in the panels 22 and 23 and are of a length so that, when the center portion of the bottom panel is set up, the slots will interfit with the slots of such panels 22 and 23.

In setting up the blank 20 of FIGS. 5 – 7, the center portion of the bottom panel 21 is folded upwardly along the hinge lines 21*a* and 21*c* with the hinge line 21*b* forming the top edge of double wall panel. Such double wall panel will be parallel to two opposite sides of the bottom panel. The panels 22, 23, 24 and 25 can now be folded upwardly and crosswise with the slots interfitting in the same manner as blank 10 of FIGS. 1 – 4. In its completed set up form the partition tray shown in FIGS. 6 and 7 is virtually the same as the tray of FIGS. 3 and 4 except that there is another column of cells. Of course, as stated above, the blank 10 of FIGS. 1 – 4 can also be varied to provide such extra column of cells.

The completed partition tray can be inserted into a box or a section of a box to provide cells suitable for packaging various products. In my copending application Ser. No. 599,992, filed July 29, 1975, there is described and claimed a partition tray with a center section particularly adapted to receive the partition tray of the present invention.

Thus, among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A one sheet generally rectangular blank adapted for folding into a partition tray having rows and columns of cells comprising:

a generally rectangular bottom panel; and four generally rectangular cell panels forming a frame around the said bottom panel;

two opposite of said cell panels having a length equal to the length of a row of cells plus the length of the side of one cell and the other two of said cell panels having a length equal to the length of a column of cells plus the length of the side of one cell;

each of said cell panels a. having a width equal to the desired height of the cells;

b. being connected at a corresponding corner of the said cell panel to a different but corresponding corner of the said bottom panel along a first hinge score line extending from the said corner of the said cell panel a distance equal to the length of a side of a said cell; and c. being divided into cells defined by a second hinge score line across the panel normal to the first hinge score line at the end of the first hinge score line away from the said corner of the said cell panel and by slots extending into the panel from a longitudinal edge of the said cell panel;

the said two opposite of the said cell panels being adapted to be folded along the said hinge score lines over the bottom panel to form the walls of the rows of the said cells and the other two of said cell panels being adapted to be folded along the said hinge score lines over the bottom at right angles to the two opposite cell panels to form the walls of the columns of the said cells;

the said slots of the said cell panels being so cut that they will permit the said cell panels to fit together and interlock with each other at the lines of intersection of the said cell panels.

2. The blank of claim 1 wherein the slots of two of two opposite cell panels are cut into the longitudinal edges adjacent the said bottom panel and the slots of the other two of the said cell panels are cut into the longitudinal edges opposite the said bottom panel.

3. The blank of claim 1 wherein the bottom panel comprises two adjacent center portions, defined by three equally spaced score lines parallel to each other and to two opposite edges of the bottom panel, and spaced slots crossing the center score line at right angles, the said portions and slots when the blank is set up being adapted and positioned to form a double wall center panel normal to the bottom panel lined up to form center cell walls of the tray with the slots of such double wall center panel engaging the slots of the said intersecting cell panels.

4. A partition tray having rows and columns of cells comprising:

a generally rectangular bottom panel; and four generally rectangular cell panels normal to the bottom and defining the cells;

two opposite of said cell panels having a length equal to the length of a row of cells plus the length of the side of one cell and the other two of said cell panels having a length equal to the length of a column of cells plus the length of the side of one cell;

each of said cell panels a. having a width equal to the desired height of the cells;

b. being connected at a corresponding corner of the said cell panel to a different but corresponding corner of the said bottom panel along a first hinge score line extending from the said corner of the said cell panel a distance equal to the length of the side of a said cell; and c. being divided into cells defined by a second hinge score line across the panel normal to the first hinge score line at the end of the first hinge score line away from the said corner of the said cell panel and by slots extending into the panel from a longitudinal edge of the said cell panel;

the said opposite of the said cell panels being folded along the said hinge score lines over the bottom panel forming the walls of the rows of said cells and the other two of the said cell panels being folded along the said hinge score lines over the bottom at right angles to the two opposite cell panels to form the walls of the columns of the said cells;

the said slots of the said cell panels being so cut that they permit the said panels to fit together and interlock with each other at the lines of intersection of the said cell panels.

5. The tray of claim 4 wherein the slots of two of two opposite cell panels are cut into the longitudinal edges adjacent the said bottom panel and the slots of the other two of the said cell panels are cut into the longitudinal edges opposite the said bottom panel.

6. The tray of claim 4 wherein the bottom panel comprises two adjacent center portions, defined by three equally spaced score lines parallel to each other and to two opposite edges of the bottom panel, the said portions being folded upwardly to form a double wall center panel normal to the bottom panel, and slots cut into the said portions, which double wall center panel and slots are adapted and positioned to form center cell walls of the tray with the slots of such double wall center panel engaging the slots of the said intersecting cell panels.

* * * * *